US009962757B2

(12) United States Patent
Legge

(10) Patent No.: US 9,962,757 B2
(45) Date of Patent: May 8, 2018

(54) AMMUNITION PRODUCTION

(71) Applicant: BAE SYSTEMS plc, London (GB)

(72) Inventor: John Frederick Legge, Crewe (GB)

(73) Assignee: BAE SYSTEMS plc, London (GB)

( * ) Notice: Subject to any disclaimer, the term of this patent is extended or adjusted under 35 U.S.C. 154(b) by 0 days. days.

(21) Appl. No.: 15/021,467

(22) PCT Filed: Sep. 9, 2014

(86) PCT No.: PCT/GB2014/052721
§ 371 (c)(1),
(2) Date: Mar. 11, 2016

(87) PCT Pub. No.: WO2015/036742
PCT Pub. Date: Mar. 19, 2015

(65) Prior Publication Data

US 2016/0221066 A1 Aug. 4, 2016

(30) Foreign Application Priority Data

Sep. 13, 2013 (EP) ..... 13275216
Sep. 13, 2013 (GB) ..... 1316335.7

(51) Int. Cl.

| | |
|---|---|
| ***B21D 51/54*** | (2006.01) |
| ***B21C 1/26*** | (2006.01) |
| ***B21C 3/14*** | (2006.01) |
| ***F42B 12/38*** | (2006.01) |
| ***F42B 12/78*** | (2006.01) |
| ***F42B 33/00*** | (2006.01) |
| ***B21C 3/12*** | (2006.01) |

(52) U.S. Cl.
CPC ..... *B21D 51/54* (2013.01); *B21C 1/26* (2013.01); *B21C 3/12* (2013.01); *F42B 12/38* (2013.01); *F42B 12/78* (2013.01); *F42B 33/001* (2013.01)

(58) Field of Classification Search
CPC .. B21D 51/54; B21C 1/26; B21C 3/12; B21C 3/14; F42B 12/38; F42B 12/78; F42B 30/02; F42B 33/00; F42B 33/001
USPC ..... 102/514, 513; 86/54, 55
See application file for complete search history.

(56) References Cited

U.S. PATENT DOCUMENTS 2,336,143 A * 12/1943 Werme ..... B23K 31/02 102/514
2,345,552 A * 4/1944 Ballou ..... F42B 33/025 86/30

(Continued)

FOREIGN PATENT DOCUMENTS

JP 2007278631 A 10/2007
WO 2015036742 A1 3/2015

OTHER PUBLICATIONS

International Search Report and Written Opinion received for Patent Application No. PCT/GB2014/052721 dated Jan. 23, 2015. 7 pages.

(Continued)

*Primary Examiner* — James S Bergin
(74) *Attorney, Agent, or Firm* — Finch & Maloney PLLC

(57) ABSTRACT

The invention relates to a construction method for improved tracer ammunition production.
There is provided a method of forming a component for a round, said method comprising the step of causing said component to be drawn through at least one floating die.

12 Claims, 2 Drawing Sheets

(56) References Cited

U.S. PATENT DOCUMENTS

Figure 1B:
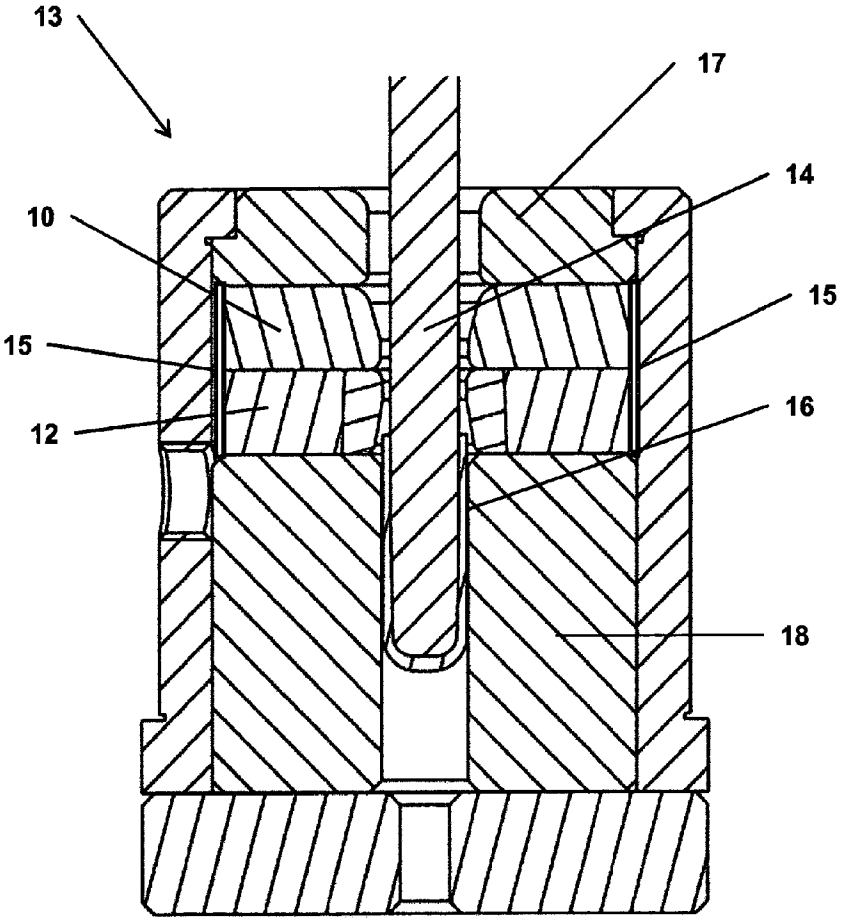

| | | | | |
|---|---|---|---|---|
| 2,402,018 | A * | 6/1946 | Burdett | F42B 12/44<br>86/23 |
| 3,577,753 | A | 5/1971 | Shah et al. | |
| 4,528,911 | A * | 7/1985 | DePhillipo | F42B 12/38<br>102/513 |
| 2015/0107481 | A1* | 4/2015 | Nygaard | F42B 12/74<br>102/514 |

OTHER PUBLICATIONS

GB Intellectual Property Office Search Report under Section 17(5) received for GB Patent Application No. 1316335.7 dated Mar. 5, 2014. 3 pages.

Extended European Search Report received for EP Patent Application No. 13275216.3 dated Mar. 18, 2014. 5 pages.

International Preliminary Report on Patentability received for Patent Application No. PCT/GB2014/052721 dated Mar. 24, 2016. 5 pages.

* cited by examiner

AMMUNITION PRODUCTION

The invention relates to a method of improved ammunition production, more specifically tracer ammunition production.

The manufacture of rounds for use in small arms follows a standardised process and involves the separate construction of a projectile and a case the latter comprising a primer and a propellant to propel the projectile. Both the case and projectile are typically formed from a ductile material that is capable of being extruded through a series of dies. The projectile and case components are joined as part of the final stages of the process to form the round, which then undergoes a quality check.

The case may be initially formed as a metal cup, which is passed through a series of dies to form a longer, thinner metal cylinder. The base of the metal cup is shaped to receive a percussion cap and ejection ridges.

The projectile in a traditional ball round projectile may comprise, a metal jacket, formed from an extrudable outer sheath which is pressed through a series of dies, an inner lead core and optionally a steel tip fitted inside the metal jacket. The metal jacket is typically made from copper or gilding metal, with the inner core selected from lead and optionally with a hardened steel tip. In the manufacture of a tracer round projectile the projectiles have an extended jacket which extends behind the inner core to form a cavity which is capable of receiving a quantity of pyrotechnic material. This pyrotechnic material is ignited as the round is fired and burns so that it may be observed as the projectile travels toward a target.

According to a first aspect of the invention there is provided a method of forming a component for a round, said method comprising the step of causing said component to be drawn through at least one floating die.

The component may be a projectile or a casing. The projectile may comprise an extrudable outer sheath which encapsulates an inner core. The inner core may be a high density metal, such as, for example, lead, steel or an alloy thereof. The inner core may further comprise a hardened tip at the ogive portion of the projectile, such that both the inner core and hardened tip are encapsulated in said extrudable outer sheath. The extrudable outer sheath may be selected from copper, steel, a copper steel laminate, such as for example a gilding metal, or their alloys thereof. The projectiles extrudable outer sheath extrudes beyond said inner core to form a cavity, where the cavity may comprise at least one pyrotechnic composition.

The tracer projectiles' extrudable outer sheath maybe formed initially from a metal cup, such that once the metal cup has passed through at least one floating die it forms an extrudable outer sheath. The extrudable outer sheath may comprise a metal laminate, or gilded structure, in a preferred arrangement the extrudable outer sheath comprises a steel layer coated on both surfaces with at least one layer of a metal alloy comprising 90% copper and 10% zinc. The extrudable outer sheath as it is passed through he at least one floating die may be lubricated with an oil, preferably a natural oil, more preferably a vegetable oil. It has been unexpectedly found that extra virgin olive oil has the desired viscosity to lubricate the extrudable outer sheath and floating dies. The use of natural oil mitigates the problems of disposal of carcinogenic crude oil derivatives. The extrudable outer sheath is drawn down to the required dimensions using a press with a mandrel which moves through the at least one floating die. There may be a plurality of separate stations, each of which may comprise at least one floating die, preferably in the range of from 2 to 6 floating dies. The use of more than one floating die at each station allows for a larger number of processing steps to be achieved.

The floating die may comprise a forming die or drawing die and maybe manufactured from a combination of steel and tungsten carbide. A forming die may shape the extrudable outer sheath into the necessary shape of a projectile, whereas a drawing die reduces the diameter of the extrudable outer sheath with a concomitant increase in the length of the extrudable outer sheath.

The station is a portion of a transfer loading press, which comprises a mandrel (or punch) and at least one floating die which are caused to move together under high pressure to cause drawing or forming of a component; successive stations having different diameter or shaped floating dies. The stations are reached by moving the extrudable outer sheath between each station using feed fingers that individually load and unload the extrudable outer sheath; blind-end down into the sequence of floating dies. The near final formed extrudable outer sheath has a lead inner core inserted leaving a cavity behind the inner core to house the pyrotechnic material. The extrudable outer sheath, inner core and any optional hardened tips are drawn to retain the inner core and tip in place. Once formed the tracer projectile undergoes a visual and multi-gauge inspection check. The envelope wall variation may be measured using a Dial Test Indicator, here the tracer projectile is placed on a test mandrel where it is turned through 360 degrees, during which time the projectile wall thickness is measured and displayed. If the tracer projectile passes this inspection it is passed to an assembly area where a pyrotechnic material is inserted into the cavity, typically under load, such as, for example by pressing or consolidating. The projectile is then pressed into a casing to provide the final round.

Tracer projectiles previously used fixed die drawing, where the die or dies are rigidly fixed in place, which relies on a machinist to conduct minor adjustments to the die and mandrel to ensure that the pressure supplied during a pressing action is centralised such that the extrudable outer sheath and hence projectile has the lowest possible wall thickness variation. Wall thickness variation of the extrudable outer sheath, particularly the portion which forms the unsupported walls, which define the cavity (for housing the tracer pyrotechnic composition), impacts the accuracy of tracer projectiles. If the selected rounds fall below 70% accuracy the entire batch of rounds is rejected. As a tracer projectile's centre of gravity is different to that of a normal projectile (due to the cavity filled with pyrotechnic material), any variation in wall thickness will have a greater impact on the flight accuracy of the round. Therefore is very desirable that the tracer projectile's wall thickness variation especially that of the unsupported wall of the cavity should be kept to a minimum.

The use of fixed die drawing causes significant failure rates, an initial metal cup which forms the extrudable outer sheath with an initial wall variation of 0.01 mm could increase to up to 0.06 mm during the first draw step due to the mismatch of dies. The use of a floating die allows the die to self-align when the extrudable outer sheath is drawn. The use of at least one floating die has provided unexpectedly tight tolerances with a maximum wall variation of 0.03 mm with a mean of 0.02 mm, a significant increase in manufacturing accuracy and a concomitant reduction in rejection rates. According to a further aspect of the invention there is provided a tracer projectile comprising an elongate extrudable outer sheath, which encapsulates an inner core, located rearwardly of the solid inner core is at least one consolidated energetic material, wherein said extrudable outer sheath has a maximum wall thickness variation of 0.03 mm.

Due to high rejection rates with the fixed die process, batch production is undertaken in small batches. A further advantage of the use of at least one floating die is that tracer projectiles can be manufactured in larger batch volumes prior to an inspection due to increased reproducibility. The process of allowing the die to float prevents the need for additional machine tooling to attempt to achieve more optimal results, the die can move i.e. self-align, rather than being kept in a position where it is mismatched to the pressing action of the mandrel.

Whilst the method has been described above, it extends to any inventive combination of the features set out above, or in the following description, drawings or claims.

Figure 1A:
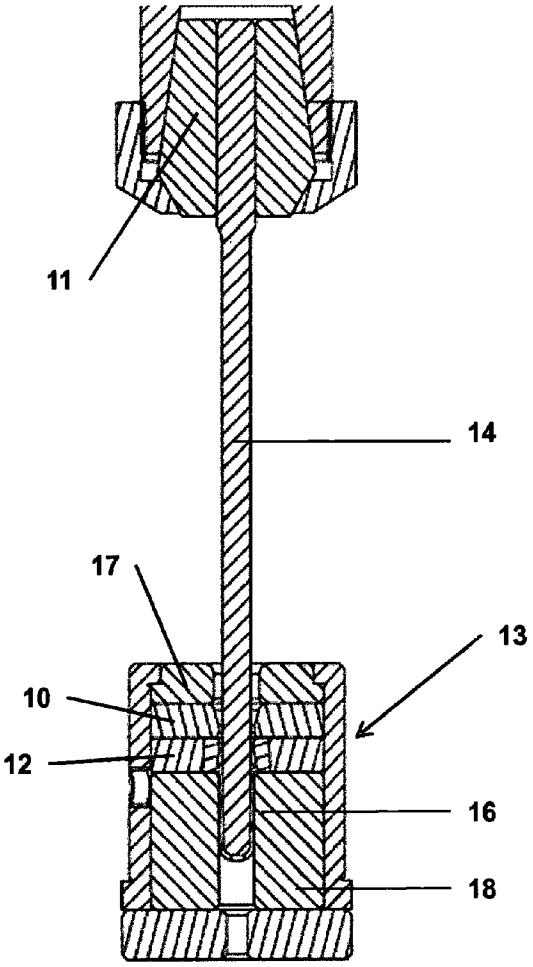

Exemplary embodiments of the device in accordance with the invention will now be described with reference to the accompanying drawings in which:

FIG. 1*a*: Is a cross section of the floating die and press assembly.

FIG. 1*b*: Is a cross section of the floating die and mandrel.

Figure 2:
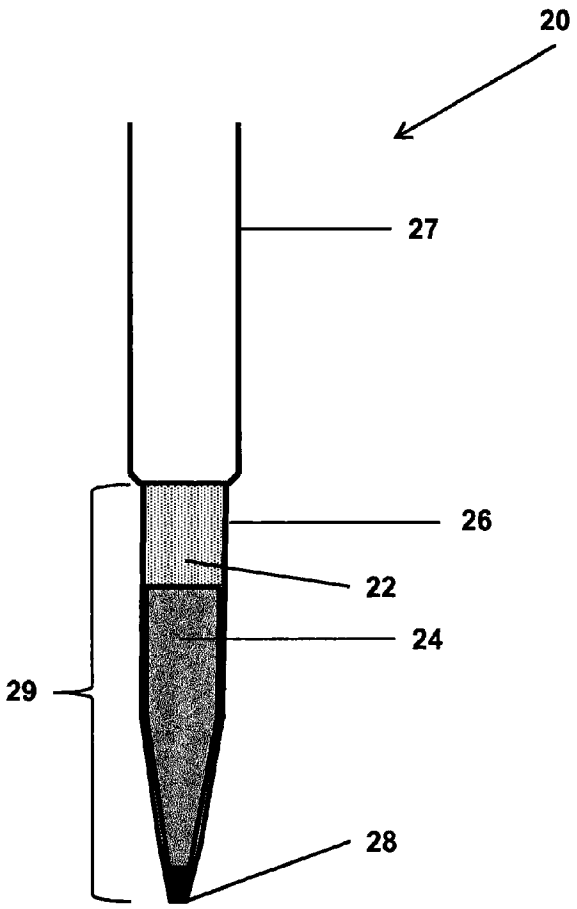

FIG. 2: Is a cross section of a tracer projectile.

Referring to FIG. 1*a* there is shown a floating die assembly 13 where the extrudable outer sheath 16 is passed through a top guide die 17, which acts as a guide to lead the extrudable outer sheath 16 into a first floating die 10 and the second floating die 12. The first die 10 and second die 12 are floating thereby allowing the press to push the mandrel 14, which is contained in a mandrel holder 11, through the top guide die 17 into the extrudable outer sheath 16 in order to form or draw it. The fourth die 18 is a spacer die, which provides room for the mandrel 14 to work, but does no work on the extrudable outer sheath 16 itself.

Referring to FIG. 1*b* there is shown a close up of the floating draw die assembly 13 of FIG. 1*a*, where self-adjustment areas 15 can be seen at the external diameters of the first floating die 10 and second floating die 12. The self-adjustment area 15, allows for the self-centring of the floating dies 10 and 12, with respect to the mandrel 14, to allow a more uniform wall thickness to be achieved during pressing of the extrudable outer sheath 16.

Referring to FIG. 2 there is shown a tracer round 20 with attached case 27. The round 20 has a projectile 29 which is formed from an extruded outer sheath 26 made from a metal laminate. The extrudable outer sheath 26 has an inner core 24 which may contain a hardened tip 28. Behind the inner core is a quantity of pyrotechnic material 22, which is ignited by the thermal output of a gun propellant.

The invention claimed is:

1. A method of forming a tracer projectile comprising an elongate extrudable outer sheath, which encapsulates an inner core, and located rearwardly of the inner core is a cavity, said method comprising:

passing the elongate extrudable outer sheath through a top guide to lead the extrudable outer sheath into at least one floating die to form said cavity, wherein said tracer projectile comprises the inner core encapsulated in the extrudable outer sheath;

causing said elongate extrudable outer sheath to be drawn through or formed by the at least one floating die; and wherein said cavity is for receiving a consolidated pyrotechnic.

2. The method according to claim 1, wherein the extrudable outer sheath is selected from copper, steel, a copper steel laminate, or alloys thereof.

3. The method according to claim 1, wherein said inner core comprises a high density metal.

4. The method according to claim 3, wherein said high density metal is selected from lead or an alloy thereof.

5. The method according to claim 1, wherein said inner core further comprises a hardened tip.

6. The method according to claim 1, wherein said extrudable outer sheath extrudes beyond said inner core to form said cavity.

7. The method according to claim 1, further comprising lubricating said extrudable outer sheath and at least one floating die, as the extrudable outer sheath is formed, wherein the lubricant is olive oil.

8. The method according claim 1, further comprising one or more of: introducing a consolidated pyrotechnic into the cavity; and attaching said tracer projectile to a case.

9. The method according to claim 8, wherein the case material is brass.

10. The method according to claim 1, wherein the floating die is manufactured from steel and tungsten carbide.

11. The method according to claim 1, wherein the floating die is a forming die.

12. The method according to claim 1, wherein the floating die is a drawing die.

* * * * *